United States Patent [19]

Mousel

[11] Patent Number: 4,601,464

[45] Date of Patent: Jul. 22, 1986

[54] LEGS EXERCISING PHYSICAL THERAPY DEVICE

[76] Inventor: Canellen K. Mousel, 801 Eleventh St., Arapahoe, Nebr. 68922

[21] Appl. No.: 644,029

[22] Filed: Aug. 24, 1984

[51] Int. Cl.[4] ..... A63B 23/04

[52] U.S. Cl. ..... 272/73; 272/900; 272/DIG. 4; 128/25 B

[58] Field of Search ..... 128/25 B, 25 R; 272/73, 272/900, DIG. 4; 5/81 R, 81 B, 83

[56] References Cited

U.S. PATENT DOCUMENTS 2,190,895 2/1940 Turpin ..... 272/73

4,515,361 5/1985 Melillo ..... 272/900

*Primary Examiner*—Richard J. Apley

*Assistant Examiner*—John L. Welsh

[57] ABSTRACT

For partially or wholly non-ambulatory patients, a legs exercising physical therapy device of the pedals operated crank type possesses various adjustment features permitting the device to be utilized in conjunction with the patient's own carrier support (e.g. a chair, a bed, etc.) and permitting the device to readily accommodate for the patient's own anatomical measurements. The legs exercising physical therapy device includes: a substantially horizontal transverse-bar at the base portion thereof; an upright standard supporting the pedals operated crank and having a controllably adjustable height above the base transverse-bar; a pair of substantially horizontal, longitudinally telescoping, and transversely separated elongate wings which at frontal-portions flank the upright standard and there are releasably lockably pivotably connected to the transverse-bar; rearward-portions of the wings being adapted to anchor to a chair, a bed, or other patient carrier support; and together with other optional features for the physical therapy device.

3 Claims, 8 Drawing Figures

FIG. 4
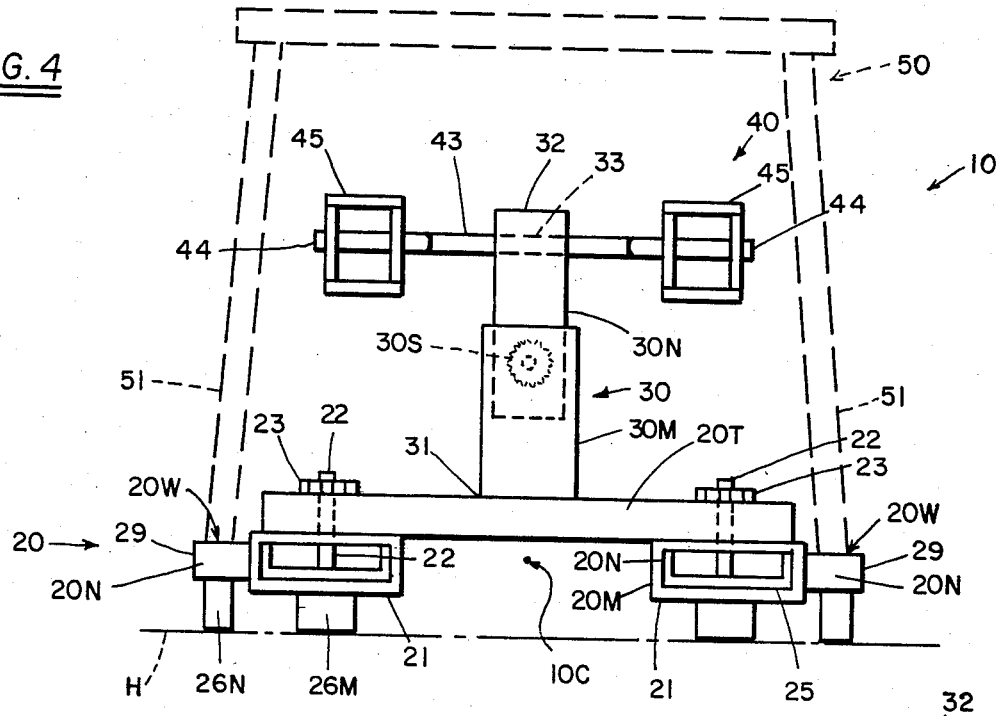
FIG. 7
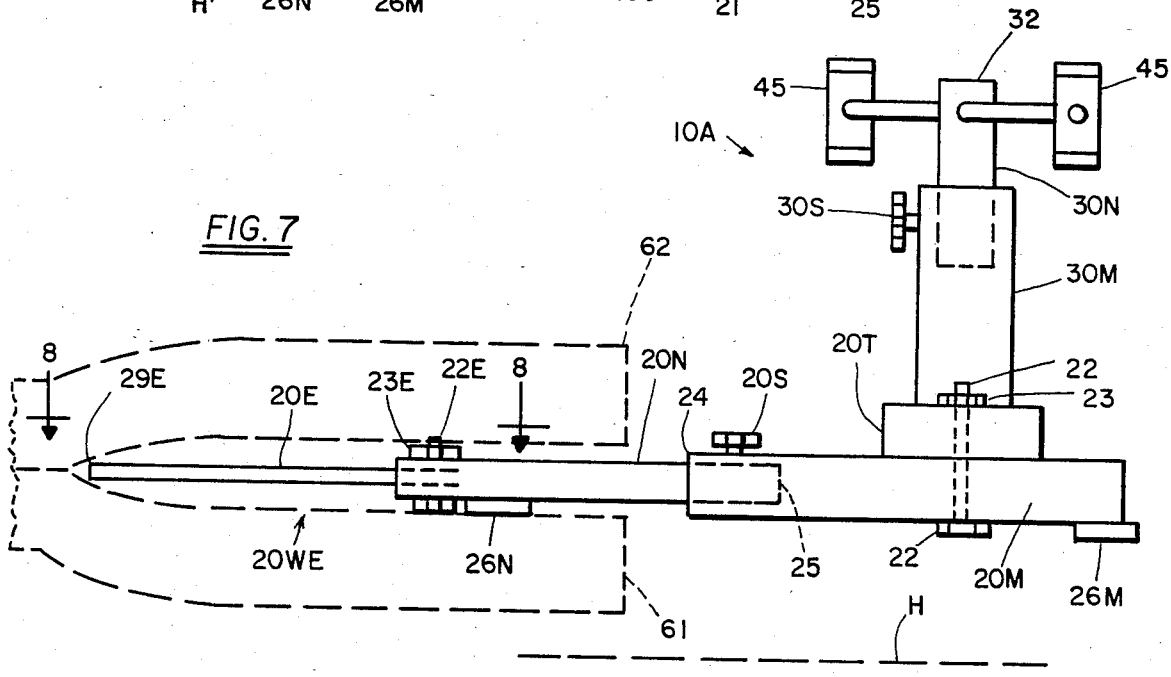
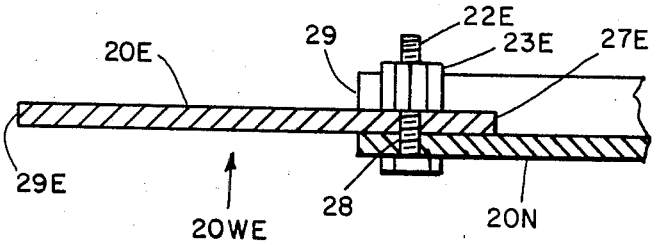
FIG. 6

LEGS EXERCISING PHYSICAL THERAPY DEVICE

BACKGROUND OF THE INVENTION

For patients who suffer from physical maladies rendering them partially or wholly non-ambulatory, it is usually beneficial to exercise the patient's legs eventhough his or her walking ability is impaired. For example, thrombosis, muscular atrophy, constipation, and other physical complications might further inflict a partially or wholly non-ambulatory patient denied the opportunity to exercise his or her legs.

As typified by U.S. Pat. No. 2,735,422 (Jones—Feb. 21, 1956), prior art workers have provided legs exercising physical therapy devices of the pedals operated crank type. However, the prior art devices tend to exhibit one or more of the following disadvantages and deficiencies. Some prior art devices require motorized supplemental power for the pedaled crank. Prior art devices tend to be of cumbersome structure and thereby entail excessive procurement and maintenance costs for the patient. Prior art devices are not readily adaptable to be utilized in conjunction with the patient's privately owned carrier supports, such as legs type seating chair, wheel chair, sleeping bed, etc. Nor are prior art devices readily adjustable to accomodate to the patient's own leg lengths or other personal anatomical measurements.

OBJECTIVE OF THE INVENTION

It is accordingly the general objective of the present invention to provide a legs exercising physical therapy device concept that overcomes the disadvantages and deficiencies of prior art devices. Ancillary general objectives include: the provision of a legs exercising physical therapy device of the pedals operated crank type that does not require motorized supplemental power therefor; that is of simple and reliable construction, and hence, is inexpensive to procure and maintain; that is readily adjustable for usage in conjunction with numerous chairs, beds, and other privately owned patient support carriers; and that is readily adjustable to the patient's own anatomical measurements.

GENERAL STATEMENT OF THE INVENTION

With the aforestated general objectives in view, and together with more specific objects and ancillary advantages which will become more apparent as this description proceeds, the improved legs exercising physical therapy device of the present invention generallly comprises: a base means including a substantially horizontal transverse-bar intersecting a longitudinally extending horizontal central-axis, further including a pair of substantially horizontal telescoping elongate wings which flank the central-axis and which have frontal-portions releasably lockably pivotably connected to the transverse-bar, and also including wings rearward-portions adapted to anchor to a chair or other patient carrier support; upright standard means extending vertically from the transverse-bar between the wings' frontal-portions and being provided with a bearing extending transversely therethrough, and said upright standard at the bearing being of controllably adjustable height; a cranking means wherein the central crankshaft portion is journalled by the upright standard bearing and wherein there are two crank-offset portions flanking the upright standard means and being provided with rotably secured pedals for engagement by the patient's feet; and together with other permissible optional features.

BRIEF DESCRIPTION OF THE DRAWING

In the drawing, wherein like characters refer to like parts in the several views, and in which:

FIG. 4 is a frontal elevational view of the first embodiment taken along line 4—4 of FIG. 1;

FIG. 7 is a right side elevational view of a modified embodiment of the legs exercising physical therapy device which includes all the components of the FIGS. 1–4 embodiment and including also tertiary-arm wings extensions for apt utilization in conjunction with a reclining bed type patient carrier support indicated in phantom line;

FIG. 6 is a sectional elevational view taken along line 6—6 of FIG. 5.

DETAILED DESCRIPTION OF THE DRAWING

Figure 1:
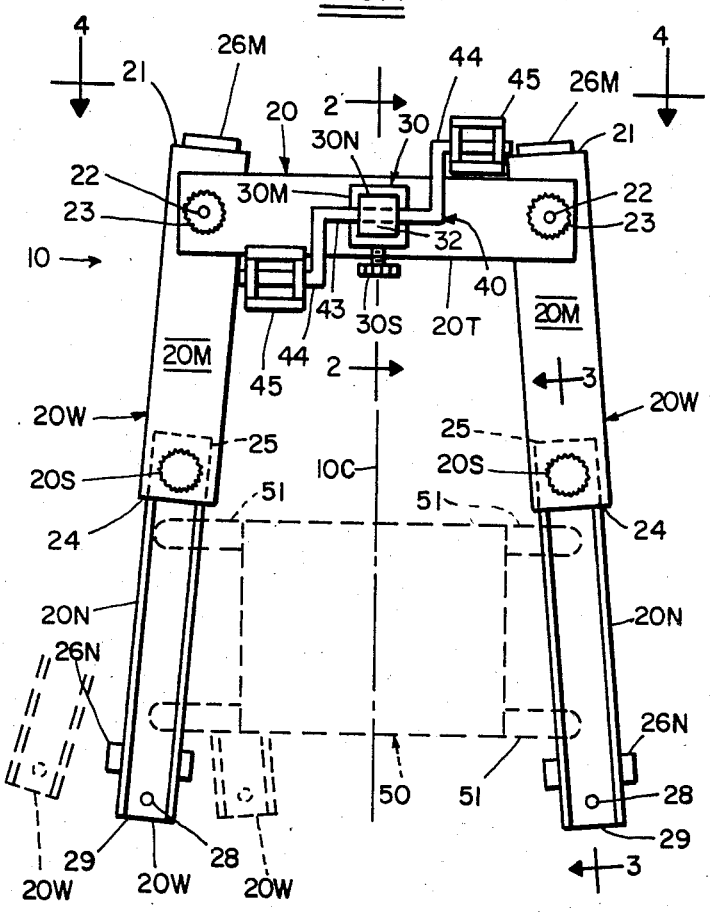
FIG. 1 is a top plan view of a representative embodiment of the legs exercising physical therapy device of the present invention. Phantom lines depict a seating chair patient carrier and indicate certain pivotal adjustments for a base member wing.
Figure 2:
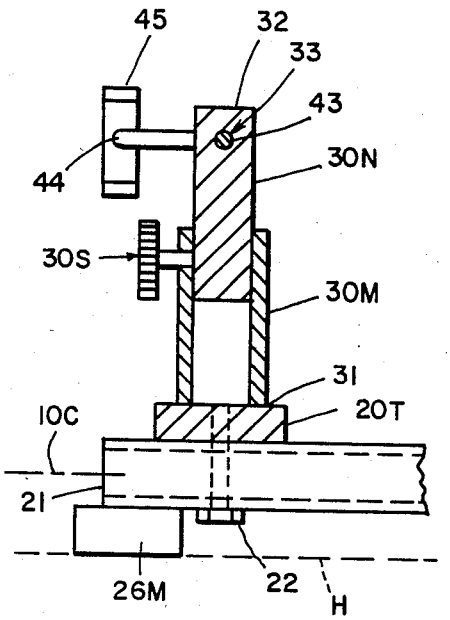
FIG. 2 is a detail sectional elevational view taken along line 2—2 of FIG. 1.
Figure 3:
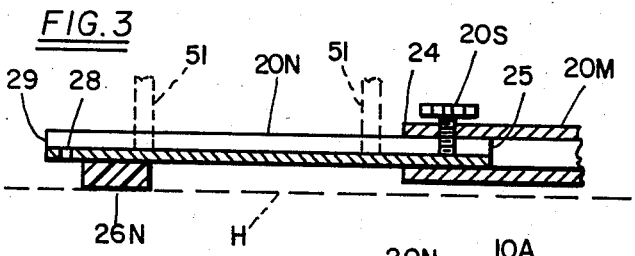
FIG. 3 is a detail sectional elevational view taken along line 3—3 of FIG. 1.

Turning initially to drawing FIGS. 1–4 which depict representative embodiment 10 of the legs exercising physical therapy device and comprising base means 20 having adjustably pivotably associated elongate wings 20W, upright standard means 30 having bearing 33, and cranking means 40 emanating from bearing 33 and having rotatably secured pedals 45 for engagement by the patient's or other user's feet.

In embodiment 10, which utilizes a chair type (e.g. 50) patient carrier support, the base means 20 is employable at substantially co-elevation with flooring "H". Base means 20 includes a substantially horizontal transverse-bar 20T perpendicularly intersecting a longitudinally extending horizontal central-axis 10C for the base means. Base means 20 further includes a pair of substantially horizontal elongate wings 20W respectively flanking central-axis 10C beneath transverse-bar 20T, and the respective wings having a frontal-portion 21 pivotably connected (e.g. at vertical bolts 22) to transverse-bar 20T and having a rearward-portion 29 located rearwardly remote transverse-bar 20T. Thus, the respective wings 20W are pivotably movable at points 22 to accommodate the spacing of chair legs 51 indicated in FIG. 1 phantom lines. There are releasable locking means for maintaining the selected angular relationships for wings 20W at transverse-bar 20T, such as the enlarged "wing" nuts 23 threadedly engaged with pivot bolts 22 and applying downward pressure upon transverse-bar 20T toward underlying wings 20W.

Preferably, each elongate wing 20W comprises a pair of telescopically associated elongate horizontal arms including a frontal primary-arm and a rearward secondary-arm whereby the horizontal wing length between frontal-portion (21) and rearward-portion (29) might be controllably selectable. In this regard, said primary-arm (e.g. 20M) has a front-end 21 defining the wings frontal-portions and a rear-end 24, and is preferably of tubularly polygonal cross-sectional shape which is desireably rectangular. In this vein, said secondary-arm (20N) has a lead-end 25 slidably disposed within tubular primary-arm 20M and has a trail-end 29 defining the wings rearward-portions. For purposes to be described later, secondary-arms 20N, nearer to trail-end 29 than to lead-end 25, are desireably vertically apertured (28) therethrough. There are primary-setscrew means (e.g. 20S) actuatably extending between a primary-arm(20M) and a secondary-arm (20N) for releasably maintaining selected telescopic relationships therebetween.

Finally, the base means 20 includes anchoring means extending from the respective base member wings and a selected patient carrier support. For embodiment 10 which is intended for use with a chair type patient carrier (e.g. 50), the anchoring means is provided with secondary-arms 20N of substantially U-shaped cross-sectional shape and thereby being adapted to accommodate the lower-ends of chair-legs 51 or even the wheels of a wheeled invalid's chair. The primary-arm and the secondary-arm of the respective base member wings are desireably provided with downwardly extending pads (e.g. 26M and 26N, respectively) for frictionally engaging horizontal flooring "H".

Having now described the base means 20 for embodiment 20, the upright standard means 30 therefor will now be described. In a general sense, the upright standard means extends vertically uprightly from the base means transverse-bar portion and is located between the wings frontal-portions in overlying relationship to longitudinal central-axis 10C. The upright standard means is provided with a bearing (33) extending transversely therethrough and is of controllably extendable height above the base means whereby the bearing (33) and crank-shaft (43) elevation above the transverse-bar 20T might be controllably selected according to the user's own anatomical measurements. Upright standard means embodiment 30 comprises a tubular collar portion 30M having a lower-end 31 non-pivotably attached to transverse-bar 20T between pivotably connected (22), wings 20W and extending uprightly from transverse-bar 20T. There is an upright riser member 30N vertically slidably associated with tubular collar 30M and below riser top-end 32 includes a transversely extending bearing 33 for journalling a cranking means (40) crank-shaft portion 43. There are standard-setscrew means 30S actuatably extending between tubular collar 30M and upright riser member 30N for releasably maintaining a patient selected height for the cranking means crank-shaft and pedals (45) portions.

Finally, the legs exercising physical therapy device embodiment 10 comprises a cranking means 40 including a pair of crank-offset portions 44 flanking central-axis 10C and the upright standard means 30 and further includes said intervening medial crank-shaft portion 43 journalled by said transversely extending bearing means 33. The respective crank-offset portions 44 are provided with rotatably secured conventional pedals 45 for engagement by the user's feet whereby he/she might pedally revolve the cranking means 40 about said loftily disposed bearing 33.

Though already having been alluded to, operation and usage of legs exercising device embodiment 10 might be summarized as follows. The user, or his/her attendant, employs the user's own selected chair as a guide for establishing and setting (e.g. at 22–23 and at 20S) the pivoted and telescoped conditions for the base means wings 20W, whereupon the chair base can be anchored (e.g. within channeled secondary-arms 20N) and the wings are frictionally engaged (e.g. at 26M and 26N) with flooring "H". Finally the height for cranking means pedals 45 is established and set (e.g. at 30S) according to the user's own leg lengths. Thus, the device 10 cranking means is in condition to be foot pedaled (e.g. at 45) by the seated patient or other user, thereby resulting in exercise for the legs and attendant therapeutic benefits previously alluded to.

Figure 5:
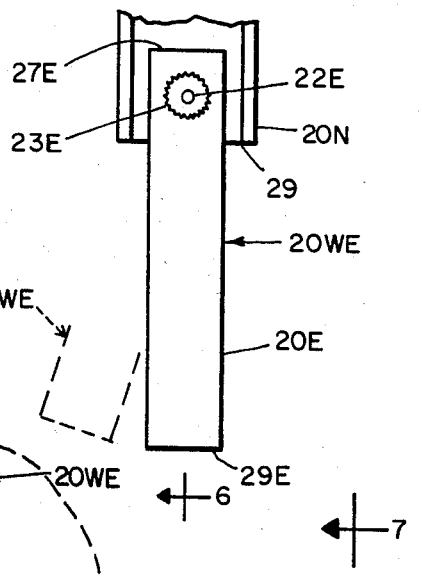
FIG. 5 is a detail of the FIG. 8 plan view, phantom line indicating pivotal adjustability for a tertiary-arm.
Figure 8:
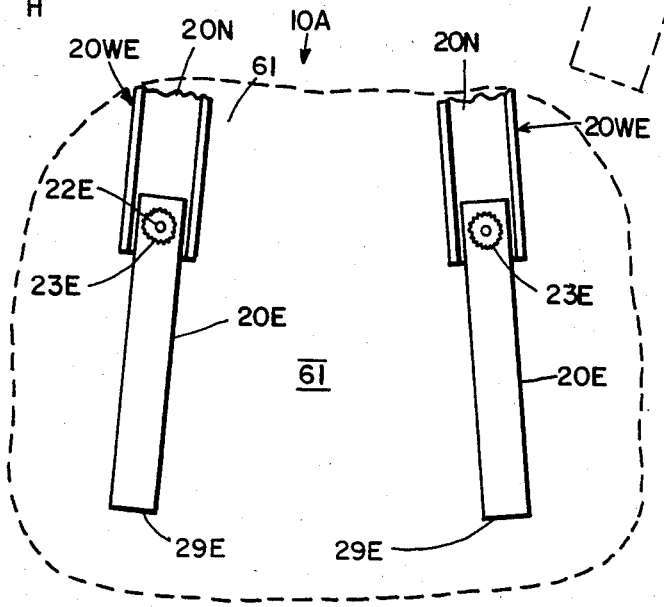
FIG. 8 is a sectional plan view of the FIGS. 5–8 modified embodiment taken along line 8—8 of FIG. 7.

Legs exercising physical therapy device embodiment 10A of FIGS. 5–8 is particularly intended for use with a patient carrier support of the reclining bed type e.g. comprising a box-spring 61 and superimposed mattress 62 together loftily overlying flooring "H". For such reclining bed usage situation, embodiment 10A might include all the components of the herebefore described embodiment 10; however, embodiment 10A employs relatively lengthier wings (20WE) as horizontally measured from frontal-portions 21 to rearward-portions 29E. This relatively greater length for wings 20WE is furnished by horizontally elongate wholly uniplanar tertiary-arm extensions 20E, each extension 20E having a head-end 27E and a tail-end 29E. Each such uniplanar tertiary-arm 20E, nearer to head-end 27E than to tail-end 29E, is wholly relegated within the channel of and pivotably attached to secondary-arm 30N (nearer to tail-end 29 than to lead-end 25), as by pivot bolt 22E passing through the secondary-arm trailward aperture 28. There are means for releasably maintaining a selected pivotal relationship between a tertiary-arm 20E and a secondary-arm 20N, such as by enlarged nut 23E threadedly engaged with pivot bolt 22E and bearing downwardly against tertiary-arm 20E toward underlying secondary-arm 20N. Thus, by virtue of the three substantially co-planar arms of wings 20WE, said wings are securely insertable between box-spring 61 and mattress 62 whereby for embodiment 10A the cranking means 40 is positionable immediately alongside the reclining bed in elevation above flooring "H". In this condition, a patient or other user occupying reclining bed 61–62 might pedally (45) operate the augmented embodiment 10A for therapeutic benefit equivalent to employing basic embodiment 10 from a seated condition (e.g. 50).

As indicated in the drawing, the several components of the device promote easy and economical shipment, compact storage, assembly, and disassembly. With embodiment 10, five threadedly engaged parts (e.g. 20S, 23 and 30S) provide the entire means to attain assembly/-disassembly; with embodiment 10A, seven threadedly engageable parts (e.g. 20S, 23, 23E, and 30S) provide the entire means for attaining assembly/disassembly. Typically, the entire disassembled device will readily fit into a 16″×16″×3″ storage box or traveling case.

From the foregoing, the construction and operation of the legs exercising physical therapy device will be readily understood and further explanation is believed to be unnecessary. However, since numerous modifications and changes will readily occur to those skilled in the art, it is not desired to limit the invention to the exact constructions shown and described, and accordingly, further modifications and equivalents may be resorted to, as encompassed by the scope of the appended claims.

I claim:

1. Legs exercising physical therapy device utilizeable alternatively with chair and sleeping bed patient carriers, said legs exercising physical therapy device comprising:

(A) a substantially horizontal transverse-bar intersecting a longitudinally extending horizontal central-axis;

(B) upright standard means including: a tubular-collar extending vertically and non-pivotable uprightly from a central portion of said transverse-bar whereby said tubular-collar overlies said central-axis, a vertical riser slidably associated within said tubular-collar and being provided with a transversely extending bearing located above said tubular-collar, and standard-setscrew means extending from the tubular-collar and against the slidably associated riser for locking the riser at various elevations;

(C) cranking means comprising a pair of crank-offset portions respectively flanking the vertical riser and further comprising an intervening crank-shaft portion journalled by said transversely extending bearing of the vertical riser, said respective crank-offset portions being provided with rotatably secured pedals for engagement by the patient's feet; and (D) a pair of elongate wings flanking said tubular-collar, the two wings having their sole connection at said transverse-bar and respectively comprising three substantially horizontal and colinearly extending arms including:

(i) a pair of substantially horizontal and tubularly polygonal primary-arms respectively having a front-end and a rear-end, said primary-arms flanking said tubular-collar and being located beneath the transverse-bar, each said primary-arm adjacent the front-end thereof being pivotably attached to the transverse-bar with a releasable locking means for maintaining the angular relationship between the primary-arm and the transverse-bar;

(ii) a pair of substantially horizontal secondary-arms of U-shaped channel cross-section and respectively having a lead-end and a trail-end, each said secondary-arm being telescopically received within a primary-arm at the rear-end thereof, and primary-setscrew means extending between the primary-arm and the secondary-arm and the secondary-arm for releasably maintaining a selected telescoped lengthwise relationship between the primary-arm and secondary-arm, wherein the secondary-arm, nearer to the trail-end than to the lead-end, is provided with a vertical aperture therethrough; and (iii) a pair of substantially horizontal and wholly uniplanar tertiary-arms and respectively having a head-end relegated within the channel of the secondary-arm, each said tertiary-arm adjacent the head-end thereof being removably connected at said aperture to the secondary-arm adjacent the trail-end thereof.

2. The device of claim 1 wherein the primary-arm is of rectangular cross-sectional shape; and wherein the secondary-arm provides an anchoring means for a seating chair type patient carrier support.

3. The device of claim 2 wherein the primary-arm and the secondary-arm of the respective wings are provided with downwardly extending pads for frictionally engaging a horizontal surface.

* * * * *